US006733255B2

(12) United States Patent
Ota et al.

(10) Patent No.: US 6,733,255 B2
(45) Date of Patent: May 11, 2004

(54) TUBE PUMP AND INK JET RECORDING APPARATUS USING THE TUBE PUMP

(75) Inventors: Mitsugu Ota, Nagano (JP); Takashi Koase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/152,978

(22) Filed: Aug. 19, 2002

(65) Prior Publication Data

US 2003/0169312 A1 Sep. 11, 2003

(30) Foreign Application Priority Data

May 24, 2001 (JP) ..... 2001-155458

(51) Int. Cl.[7] ..... F04B 43/08; F04B 43/12; B41J 2/175

(52) U.S. Cl. ..... 417/477.7; 417/477.8; 347/85

(58) Field of Search ..... 417/477.7, 477.8; 347/84, 85

(56) References Cited

U.S. PATENT DOCUMENTS 4,142,845 A * 3/1979 Lepp et al. ..... 417/477.8
5,586,873 A * 12/1996 Novak et al. ..... 417/477.8
6,082,977 A * 7/2000 Nishioka ..... 417/476
6,164,767 A * 12/2000 Nakamura et al. ..... 347/85
6,203,295 B1 * 3/2001 Nishioka ..... 417/476

* cited by examiner

*Primary Examiner*—Charles G. Freay
(74) *Attorney, Agent, or Firm*—Sughrue Mion, PLLC

(57) ABSTRACT

A groove wall of a roller support groove opened to both end faces of a pump wheel comprises such a cam face wherein a roller rotates and rolls and is displaced from release operation position a to pump operation position b with rotation of the pump wheel in a pump operation direction from a release operation state and wherein the roller remains immobile and is displaced from the pump operation position b to the release operation position a with rotation of the pump wheel in a release operation direction from a pump operation state.

8 Claims, 8 Drawing Sheets

TUBE PUMP AND INK JET RECORDING APPARATUS USING THE TUBE PUMP

The present invention is based on Japanese Patent Application No. 2001-155458, the entire contents of which are incorporated herein by reference.

BACKGROUND OF THE INVENTION

This invention relates to a tube pump using deformation of a tube for generating pressure and an ink jet recording apparatus comprising recovery device of an ink ejection capability for discharging ink from a recording head using negative pressure generated by the tube pump.

An ink jet recording apparatus produces comparatively small noise at the printing time and moreover can form small dots at a high density and thus nowadays is widely used for print centering on color print.

Such an ink jet recording apparatus comprises an ink jet recording head for receiving ink supplied from an ink cartridge and paper feed device for relatively moving record paper to the recording head.

While the recording head is moved in response to a print signal, ink droplets are ejected onto record paper for forming dots, thereby recording. In this case, a recording head capable of ejecting black ink, yellow ink, cyan ink, and magenta ink, for example, is mounted on a carriage and the ink ejection percentage is changed, thereby making full color print possible.

Since such an ink jet recording apparatus ejects ink onto record paper as ink droplets through nozzle openings for printing, it involves the following problem: clogging occurs in the nozzle openings due to a rise in ink viscosity caused by evaporation of an ink solvent from the nozzle openings, ink solidification on the nozzle formation face, or deposition of dust and further air bubbles are mixed into the recording head, causing a print failure to occur.

Thus, in addition to the recording head and the paper feed device, the ink jet recording apparatus comprises capping device for sealing the nozzle formation face of the recording head in a non-print mode, a suction pump for sucking and discharging ink into the capping device, and wiping device for cleaning the nozzle formation face of the recording head after ink is sucked and discharged by the suction pump.

To prevent clogging from occurring in the nozzle openings and air bubbles from being mixed into the recording head, ink is forcibly sucked and discharged from the recording head into the capping device by the suction pump (ink ejection capability recovery processing) and then the nozzle formation face of the recording head is wiped by the wiping device.

The forcible discharge processing of ink performed to remove clogging of the recording head or if air bubbles remain in the recording head is called cleaning operation. The cleaning operation is performed when print is restarted after the recording apparatus is in a nonoperating mode for a long time or when the user recognizes a print quality failure of faint print, etc., and presses a cleaning switch.

To perform the cleaning operation, the recording head is sealed with the capping device and a negative pressure is made to act on the inside of the capping device.

Used as a device for feeding a negative pressure into the capping device is a tube pump which has a comparatively simple structure, can be easily miniaturized, and moreover does not cause pollution in the mechanical portion for sucking and discharging ink.

The tube pump has a configuration, for example, as shown in FIGS. 7 and 8. FIG. 7 shows a pump operation state as the pump is driven in a forward direction and FIG. 8 shows a release operation state as the pump is driven in a reverse direction.

The tube pump shown in FIGS. 7 and 8 comprises a pump frame 44 having a tube support face 52 for guiding the outer shape of a flexible tube 51 to be a circular-arc manner, a pump wheel 42 rotated by a paper feed motor, for example, and rollers 43*a* and 43*b* having roller shafts 43A and 43B moving along roller support grooves 42*a* and 42*b* opened to an end face of the pump wheel 42.

The pump frame 44 is formed with L-shaped retention grooves 44*a* and 44*b* opposed to the tube support face 52 and guide members 53*a* and 53*b* made of elastic material projecting in the center direction of the pump wheel 42 are retained in the retention grooves 44*a* and 44*b*.

In such a tube pump, if the pump wheel 42 is rotated in the normal direction (arrow A direction) as shown in FIG. 7, the rollers 43*a* and 43*b* move in the outer peripheral direction of the roller support grooves 42*a* and 42*b* and are rotated and rolled while pressing the flexible tube 51 in the arrow A direction. Accordingly, a pressure is generated in the flexible tube 51 for feeding a negative pressure into the capping device. Ink is forcibly discharged from the recording head by the negative pressure and further the ink discharged into the capping device is sucked and is sent to a waste ink tank.

If the pump wheel 42 is rotated in the reverse direction (arrow B direction) as shown in FIG. 8, the rollers 43*a* and 43*b* move in the inner peripheral direction of the roller support grooves 42*a* and 42*b* and are rotated and rolled in the arrow B direction while keeping the flexible tube 51 in the release operation state in which the rollers 43*a* and 43*b* come in contact with the flexible tube 51 only a little. Accordingly, failure occurrence of the roller 43*a*, 43*b* sticking to the flexible tube 51 or the like is prevented.

In this case, the guide members 53*a* and 53*b* act so as to guide the rollers 43*a* and 43*b* in the wheel rotation backward direction of the roller support grooves 42*a* and 42*b* as the pump wheel 42 is rotated.

However, in this kind of tube pump, when the pump operation state is switched to the release operation state, the rollers 43*a* and 43*b* rotate and roll with the pump wheel 42 while pressing the flexible tube 51, and thus the following problem is involved. That is, just after the pump operation state is switched to the release operation state, the rollers 43*a* and 43*b* receive such a force displacing in the wheel rotation direction with the rollers 43*a* and 43*b* pressed into contact with the flexible tube 51 from the groove walls of the roller support grooves 42*a* and 42*b* and thus fluids of ink, air, etc. which are sucked into the flexible tube 51 flow back and the reliability on the pump quality is degraded.

On the other hand, to use the tube pump with the ink jet recording apparatus, ink bubbles are produced in the capping device because of flowback of ink, etc. which is sucked from the recording head and some of the ink bubbles may be exposed to the outside of the capping device.

If the ink bubbles are thus exposed to the outside of the capping device, when the recording head is next sealed with the capping device, as they come in contact with each other the ink bubbles are broken and this action may cause instantaneous air pressure change to occur in the nozzle openings of the recording head, destroying meniscuses of ink formed in the nozzle openings.

Consequently, the normal ejection operation of ink droplets through the nozzle openings cannot be accomplished, causing a print fault called missing dots to occur, leading to degradation of the reliability on cleaning; this is a problem.

It is therefore an object of the invention to provide a tube pump for making it possible to enhance reliability on pump quality, simplify the whole structure, and reduce costs and an ink jet recording apparatus using the tube pump to make it possible to enhance reliability on cleaning.

To this end, according to the invention, there is provided a tube pump comprising:

a pump frame having a tube support face for guiding a curve of a flexible tube in a circular-arc manner;

a pump wheel rotatably disposed in the pump frame and having a roller support groove; and a roller having a roller shaft, disposed rotatably and rollably on the pump wheel and relatively displaceable between a pump operation position and a release operation position in the roller support groove, the roller being configured to deform the flexible tube by a press contact so as to generate a pressure in the tube pump;

the roller shaft being guided by a groove wall in contact therewith;

wherein the groove wall of the roller support groove is provided with a cam face configured such that the roller is relatively displaced from the release operation position to the pump operation position in a state that the roller rotates and rolls, when the pump wheel rotates from a release operation state in a pump operation direction; and the roller is relatively displaced from the pump operation position to the release operation position in a state that the roller does not rotate and roll, when the pump wheel rotates from a pump operation state in a release operation direction.

Since the tube pump is thus configured, when the release operation state is switched to the pump operation state, the roller rotates and rolls and receives such a force displacing from the release operation position to the pump operation position from the groove wall of the roller support groove. On the other hand, when the pump operation state is switched to the release operation state, the roller remains immobile and receives such a force displacing from the pump operation position to the release operation position from the groove wall of the roller support groove.

Therefore, just after the pump operation state is switched to the release operation state, the roller is prevented from rotating and rolling in the wheel rotation direction while pressing the flexible tube, so that fluids of ink, air, etc., sucked in the flexible tube do not flow back and the reliability on the pump quality can be enhanced.

Here, it is desirable that a cam curve of the cam face should be a curve with an arbitrary point on a line represented by polar coordinates $(r, \theta)$ wherein the rotation center of the pump wheel is the origin, radius r is a function of angle $\theta$ found from $r=C_1\times\exp(\alpha\cdot\theta)$, and end angle $\theta_\beta$ is a constant found from $\theta_\beta=(1/\alpha)\times\log(C_2/C_1)$, that polar coordinates $(r, \theta)$ of both end points on the curve should be set to predetermined polar coordinates $(C_1, 0)$ and $(C_2, \theta_\beta)$, and that pressure angle $\alpha$ of the cam face with respect to the roller shaft should be set to a predetermined angle in the range of $\pi/30<\alpha<\pi/20$.

Since the tube pump is thus configured, if the pressure angle $\alpha$ is $\alpha=7\pi/180$ (7°) or $\alpha=8\pi/180$ (8°), just after the pump operation state is switched to the release operation state, the roller is prevented from rotating and rolling in the wheel rotation direction while pressing the flexible tube, so that the reliability on the pump quality can be enhanced.

If $\alpha=\pi/30$ (6°), after the pump operation state is switched to the release operation state, the roller does not move toward the release operation position at an intermediate point of the roller support groove and moves interlockingly with the pump wheel while pressing the flexible tube. If $\alpha=\pi/20$ (9°), just after the release operation state is switch to the pump operation state, the roller does not move toward the pump operation position and moves interlockingly with the pump wheel.

It is desirable that a roller guide having a guide face for guiding the roller shaft is placed on the axis of the pump wheel.

Since the tube pump is thus configured, when the roller shaft moves within the roller support groove, it is guided by the roller guide.

The tube support face may be provided such that the contact area between the flexible tube and the roller is formed all around the pump wheel.

Since the tube pump is thus configured, the contact area becomes long in the circumferential direction and thus a higher negative pressure can be provided as compared with the tube support face such that the contact area between the flexible tube and the roller is provided on half of the circumference of the pump wheel.

Further, the roller support groove is a single roller support groove at a position eccentric from the rotation center of the pump wheel.

Since the tube pump is thus configured, a single roller can be placed for the pump wheel.

The configuration wherein the roller support groove is a pair of roller support grooves positioned at parts symmetrical with respect to a point about the rotation center of the pump wheel can also be adopted.

Since the tube pump is thus configured, a pair of rollers can be placed for the pump wheel.

On the other hand, according to the invention, there is provided an ink jet recording apparatus comprising an ink jet recording head for ejecting ink droplets in response to print data; and capping device for sealing the nozzle formation face of the recording head and sucking and discharging ink from the recording head upon reception of a negative pressure from a pump unit, characterized by the above-described tube pump as the pump unit.

Since the ink jet recording apparatus is thus configured, fluids of ink, air, etc., sucked from the recording head can be prevented from flowing back into the capping device.

Therefore, ink bubbles produced as in the related art are not produced, so that destroying of meniscuses as ink bubbles are broken can be prevented.

Thus, the normal ejection operation of ink droplets through the nozzle openings can be accomplished, so that a print fault called missing dots does not occur and the reliability on cleaning can be enhanced.

DETAILED DESCRIPTION OF THE PREFERRED EMBODIMENTS

Figure 1:
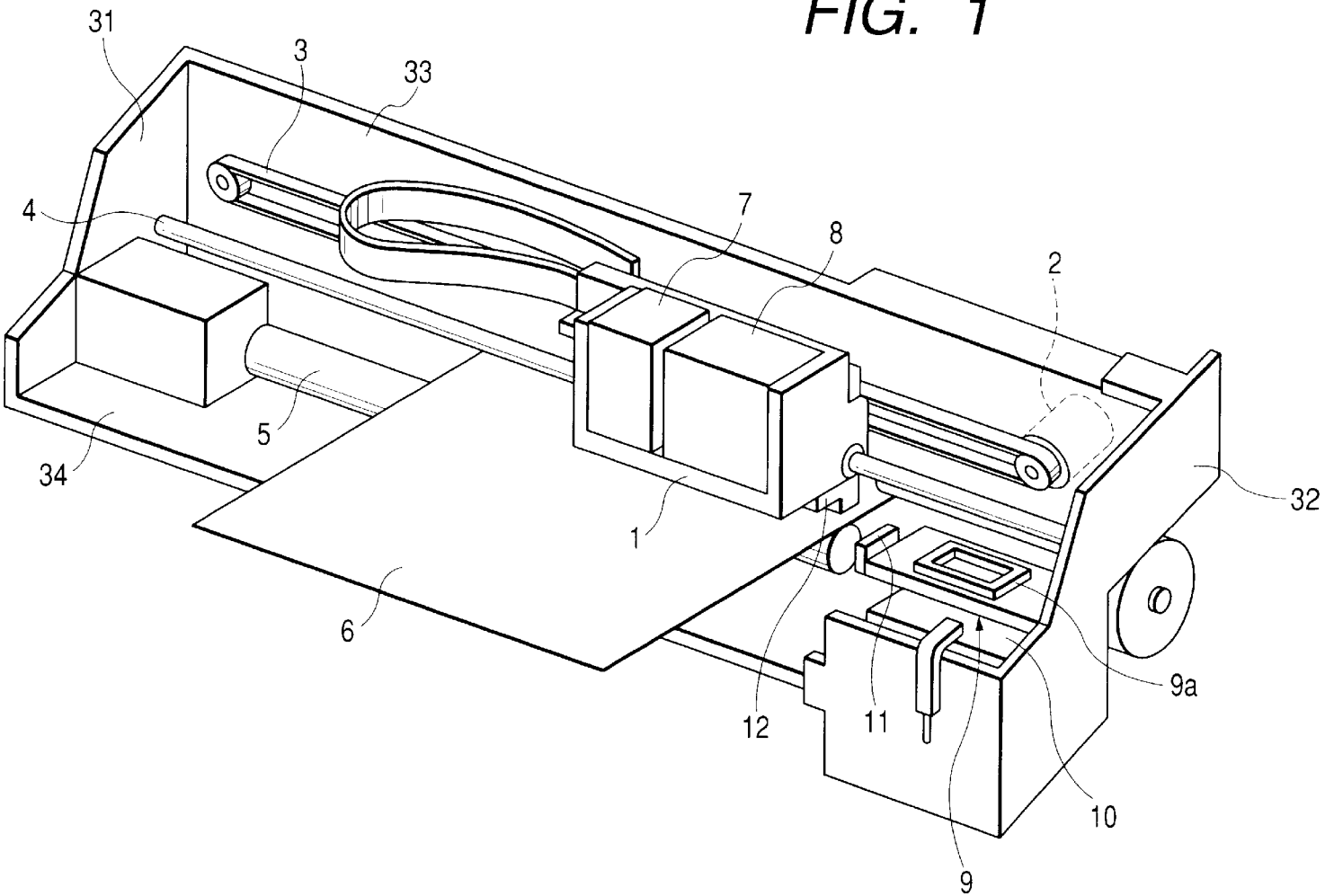
FIG. 1 is a perspective view to show an outline of the basic configuration of an ink jet recording apparatus incorporating the invention.

An ink jet recording apparatus using a tube pump according to the invention will be discussed based on an embodiment shown in the accompanying drawings. FIG. 1 is a perspective view to show an outline of the general configuration of the ink jet recording apparatus incorporating the invention.

In FIG. 1, a carriage indicated by numeral 1 can be reciprocated in the axial direction of a platen 5 as guided by a guide member 4 via a timing belt 3 driven by a carriage motor 2.

The guide member 4 is supported on two left and right frames 31 and 32 opposed to each other. Both the frames 31 and 32 are joined by a rear plate 33 and a bottom plate 34.

An ink jet recording head 12 is mounted on the lower face portion of the carriage 1 so that it is opposed to record paper 6. A black ink cartridge 7 and a color ink cartridge 8 for supplying ink to the recording head 12 are detachably held on the upper face portion-of the carriage 1.

A capping device 9 having a cap member 9*a* is placed in a non-print area (home position) in a move area of the carriage 1. When the recording head 12 moves just above the capping device 9, the capping device 9 can move up so as to seal the nozzle formation face of the recording head 12. A tube pump 10 as a pump unit to give a negative pressure to the internal space of the cap member 9*a* is placed below the capping device 9.

The capping device 9 has a function as a lid for preventing nozzle openings of the recording head 12 from being dried during the nonoperating period of the ink jet recording apparatus. It also has a function as an ink receiver during the flushing operation of applying a drive signal not involved in print to the recording head 12 for idly ejecting ink droplets and a function as cleaning device for causing a negative pressure from the tube pump 10 to act on the recording head 12 for sucking ink.

A wiping device 11 comprising an elastic plate of rubber, etc., is placed in the proximity of the print area side in the capping device 9 so that it can advance and retreat in a horizontal direction. When the carriage 1 reciprocates on the capping device 9 side, the wiping device 11 can advance onto the move path of the recording head 12.

Figure 2:
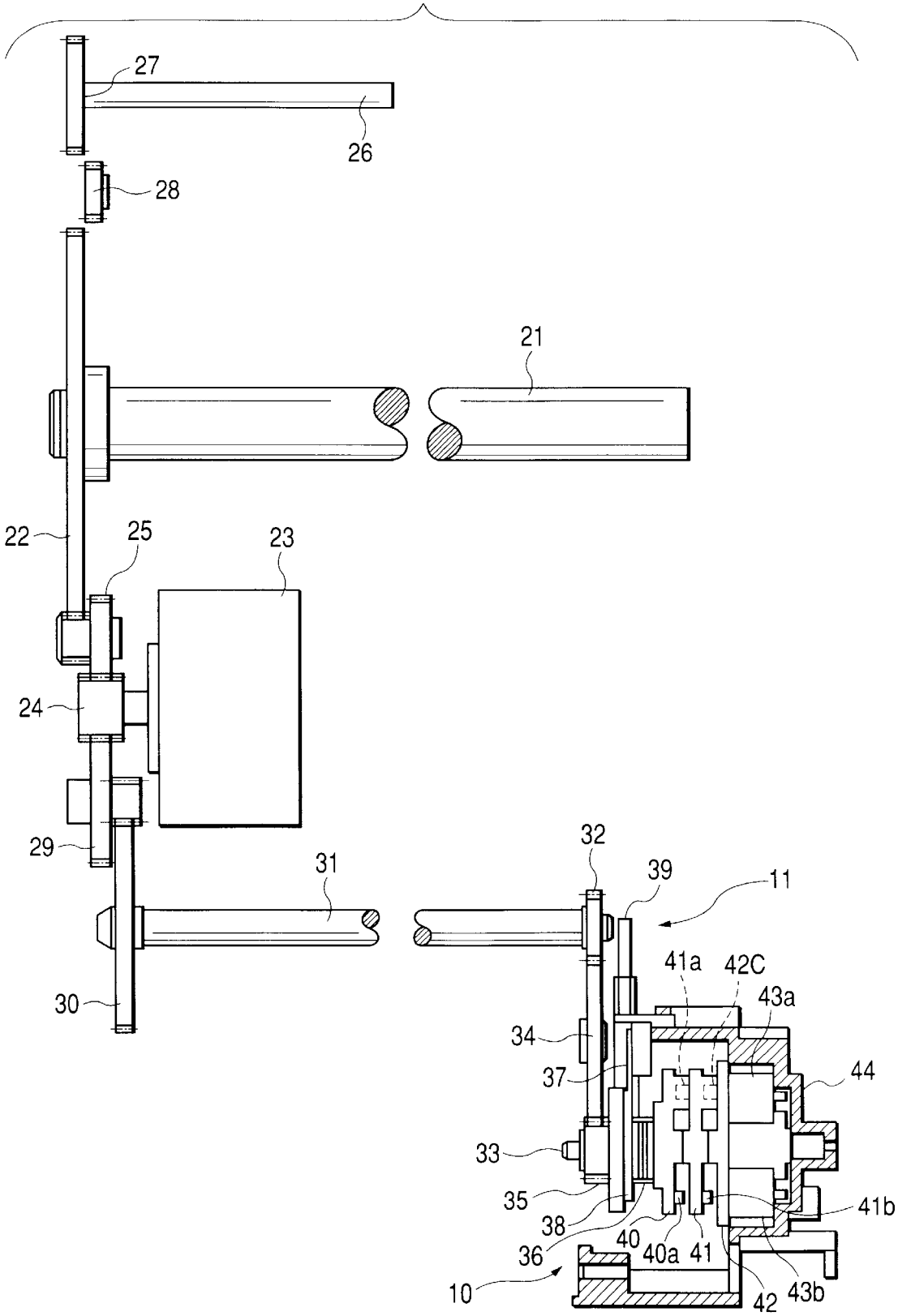
FIG. 2 is a sectional view to show an example of drive power transmission device placed in the ink jet recording apparatus shown in FIG. 1.

Next, a drive power transmission device to a paper feed and ejection mechanism and the suction pump (tube pump) placed in the ink jet recording apparatus will be discussed with reference to FIG. 2. FIG. 2 is a sectional view to show an example of the drive power transmission device to the paper feed and ejection mechanism and the suction pump placed in the ink jet recording apparatus incorporating the invention.

As shown in FIG. 2, numeral 21 denotes a paper feed roller and a gear 22 is placed at one end of the paper feed roller 21. It is driven via an idler 25 from a pinion placed on the shaft of a paper feed motor 23. A gear 27 is placed at one end of a paper feed roller drive shaft 26 and meshes with the gear 22 via a move gear 28 forming a part of a clutch mechanism for transmitting power to a cut sheet feeder (not shown) for feeding (loading) record paper.

The move gear 28 is held normally at a position distant from both the gears 22 and 27 by a spring (not shown). The move gear 28 is pressed by the carriage 1 moving to the end opposed to the home position and moves in an axial direction and is placed between both the gears 22 and 27 for allowing both the gears 22 and 27 to mesh with each other.

On the other hand, power from the paper feed motor 23 is transmitted to the pinion 24, the idler 29, and a paper ejection roller gear 30 on a paper ejection roller 31 and further power from the paper ejection roller gear 30 is transmitted to a gear 32 on the paper ejection roller 31 and then the tube pump 10 is driven by the gear 32. A gear 35 for meshing with the gear 32 via an idler 34 is placed on a drive shaft 33 of the tube pump 10.

A cleaner cam 38 having an arm 37 pressed by a spring 36 placed on the rear of the drive shaft 33 for frictional rotation is idly rotatably attached to the drive shaft 33. As the cleaner cam 38 (arm 37) is rotated, a wiping member 39 (wiping device 11) can be moved in the horizontal direction. Accordingly, as the motor turns in one direction, the wiping device 11 can advance to the move path of the recording head 12 and can wipe the nozzle formation face of the recording head 12 and as the motor turns in an opposite direction, the wiping device 11 is retreated from the move path of the recording head 12.

A ratchet wheel 40, an intermediate transmission wheel 41, and a pump wheel 42 are placed on the drive shaft 33 of the tube pump 10 so that they are stacked on each other in the axial direction. The ratchet wheel 40 is formed with a projection 40*a* on the face opposed to the intermediate transmission wheel 41 and the intermediate transmission wheel 41 is formed on both faces with projections 41*a* and 41*b*. Further, the pump wheel 42 is formed with a projection 42C on the face opposed to the intermediate transmission wheel 41.

Accordingly, the ratchet 40 rotates and the projection 40*a* thereof abuts the projection 41*a* of the intermediate transmission wheel 41, whereby the rotation force is transmitted to the intermediate transmission wheel 41. Further, the projection 41*b* of the intermediate transmission wheel 41 abuts the projection 42C of the pump wheel 42, whereby the rotation force is transmitted to the pump wheel 42. Therefore, a rotation delay mechanism is formed for generating a rotation transmission delay at the maximum of about two revolutions between the ratchet wheel 41 and the pump wheel 42 if the turn direction of the paper feed motor 23 is switched.

When record paper 6 is fed from the cut sheet feeder, the paper feed motor 23 needs to be a little forward and reversely turned to position the paper tip and eliminate a backlash, in which case the rotation delay mechanism operates so that power is not transmitted to the tube pump 10.

Figure 3:
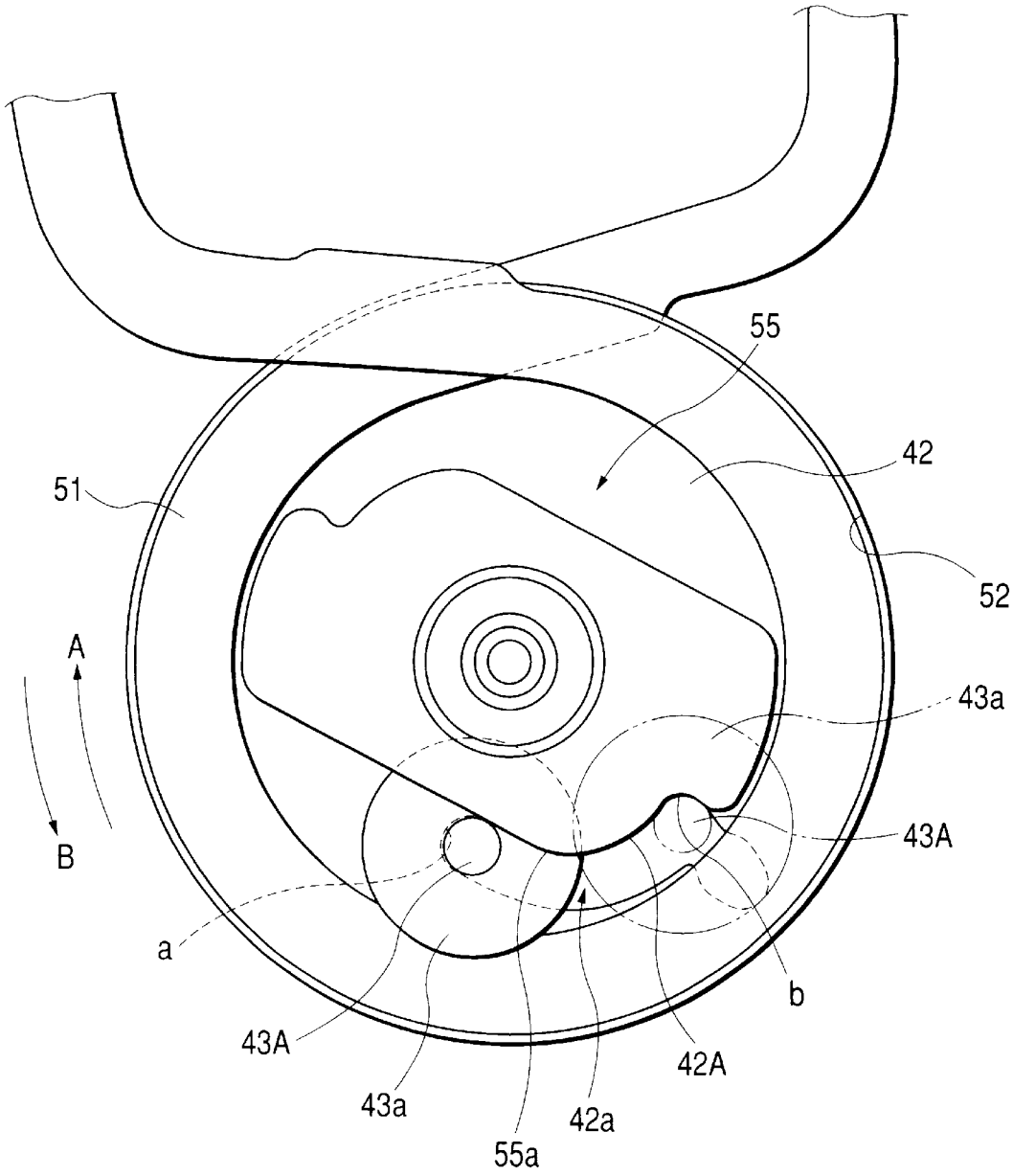
FIG. 3 is a perspective view to show the main part of a tube pump according to a first embodiment of the invention.
Figure 4:
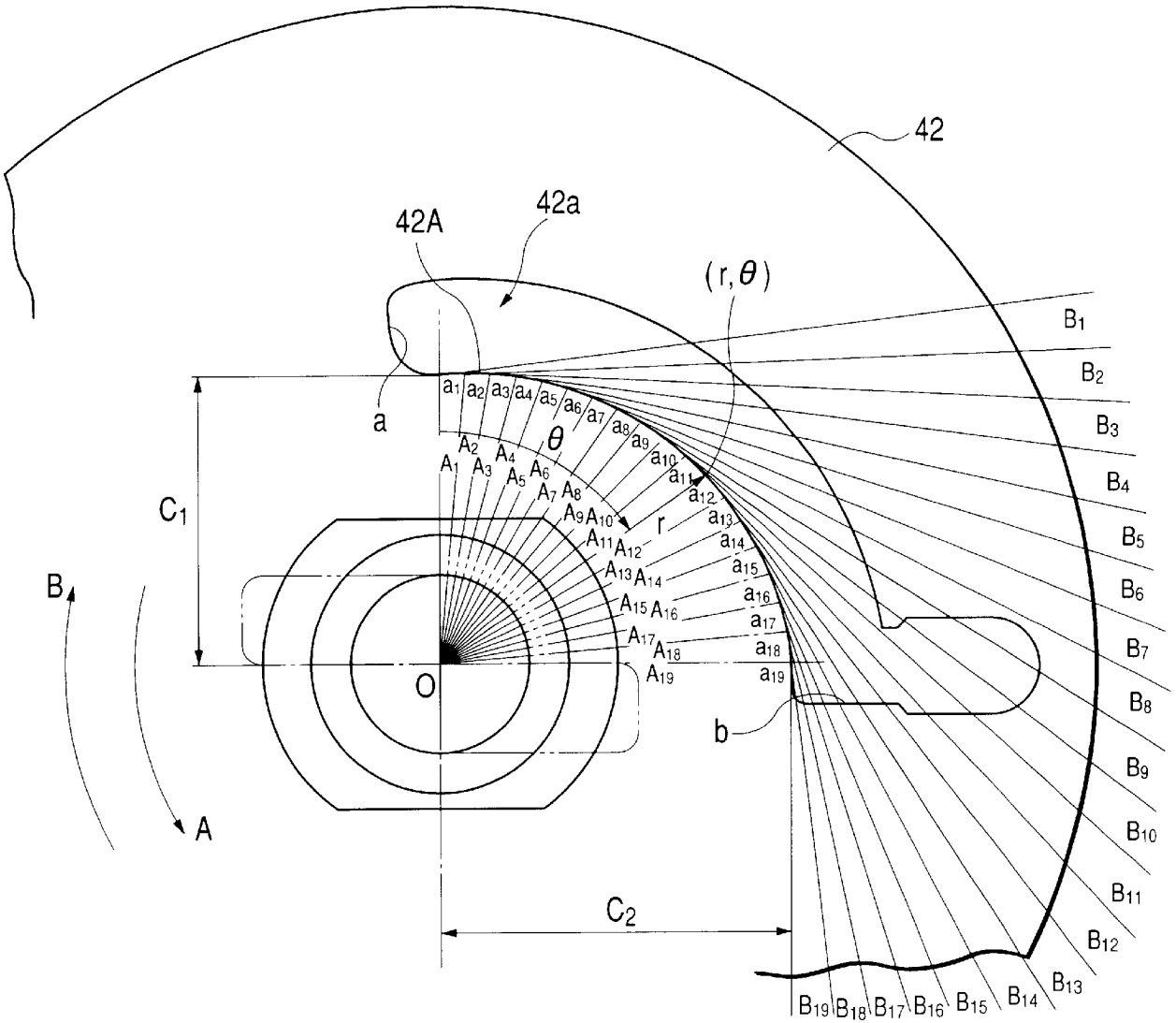
FIG. 4 is a plan view to describe a groove wall of a roller support groove of a pump wheel in the tube pump according to the first embodiment of the invention.
Figure 5:
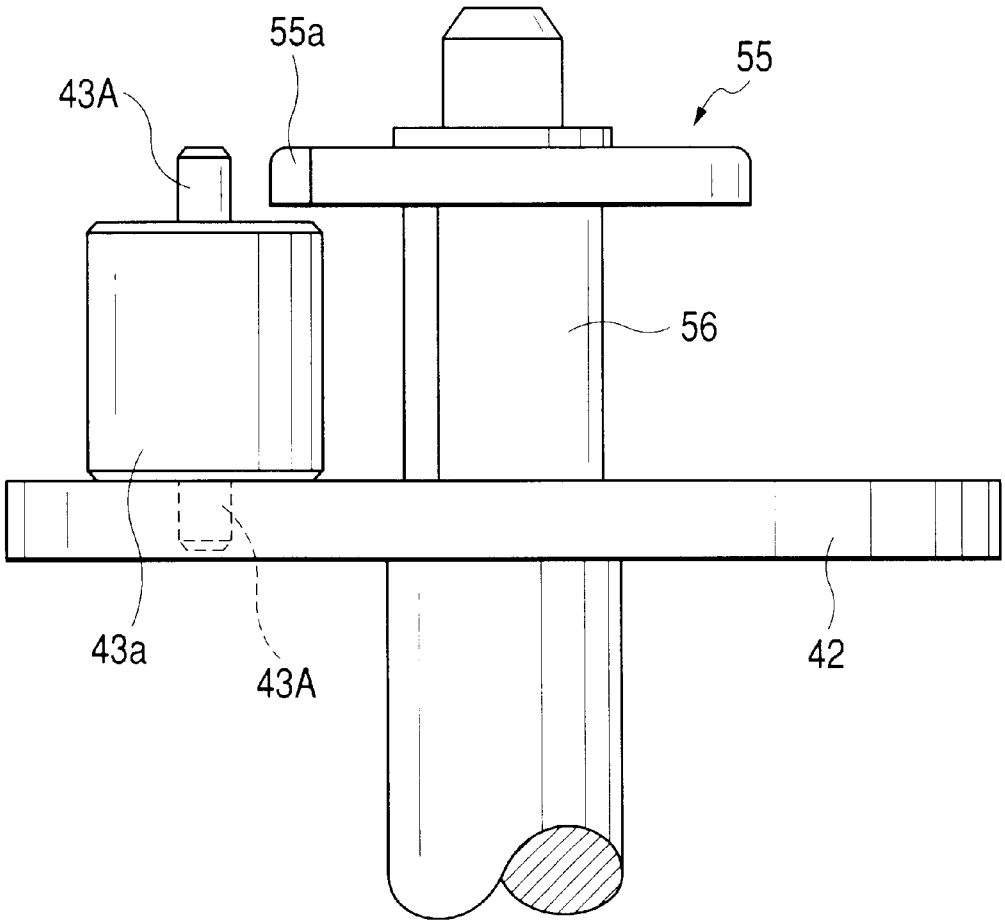
FIG. 5 is a side view to show a roller between the pump wheel and a roller guide in the tube pump according to the first embodiment of the invention.

Next, a tube pump according to a first embedment of the invention will be discussed in detail with reference to FIGS. 3 to 5. FIG. 3 is a plan view to show the main part of the tube pump incorporating the invention. FIG. 4 is a plan view to describe a roller support groove (groove wall) of a pump wheel in the tube pump incorporating the invention. FIG. 5 is a side view to show a roller between the pump wheel and a roller guide in the tube pump incorporating the invention.

Figure 7:
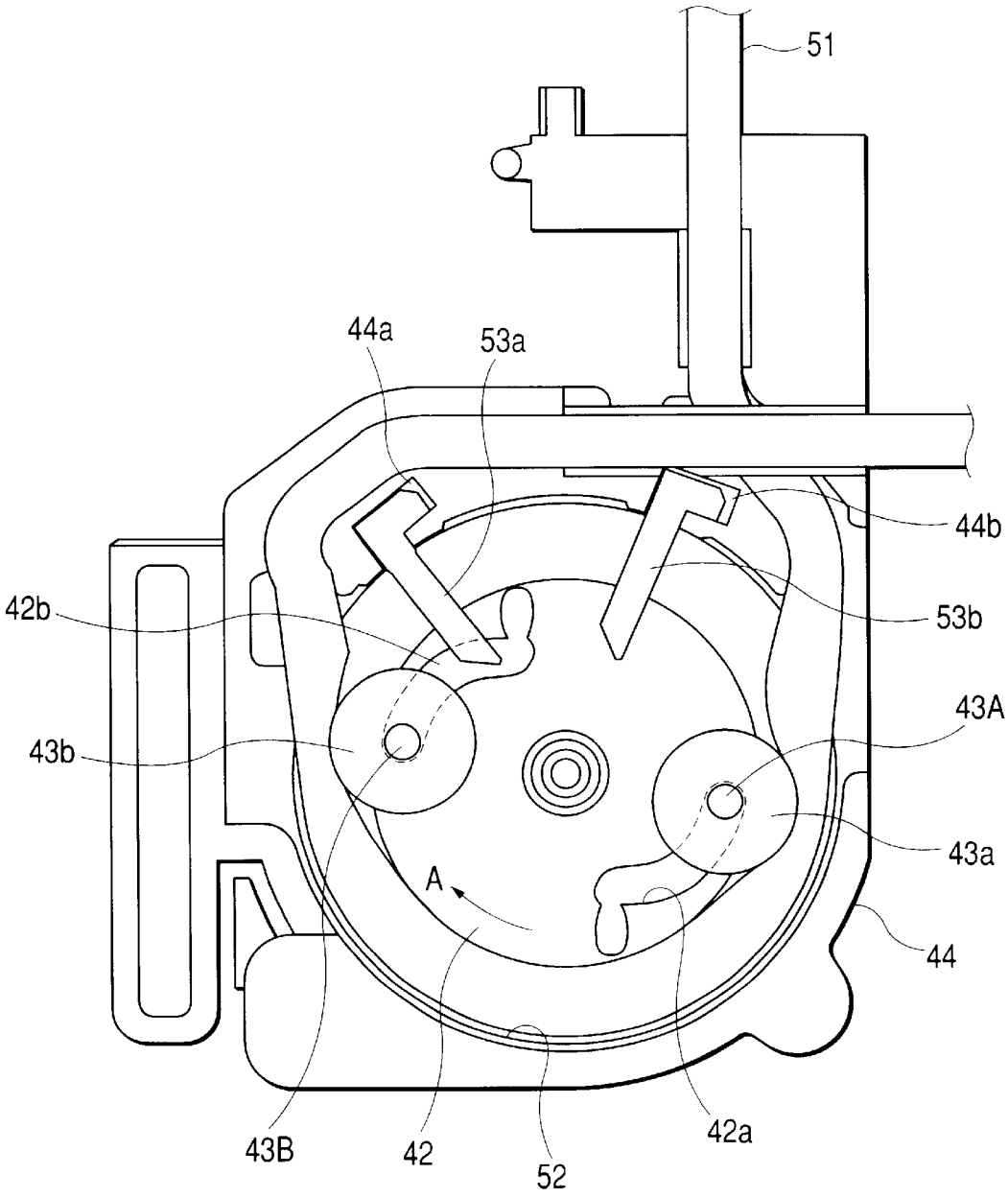
FIG. 7 is a perspective view to show a state in which a tube pump in a related art is driven in a forward direction for executing pump operation.
Figure 8:
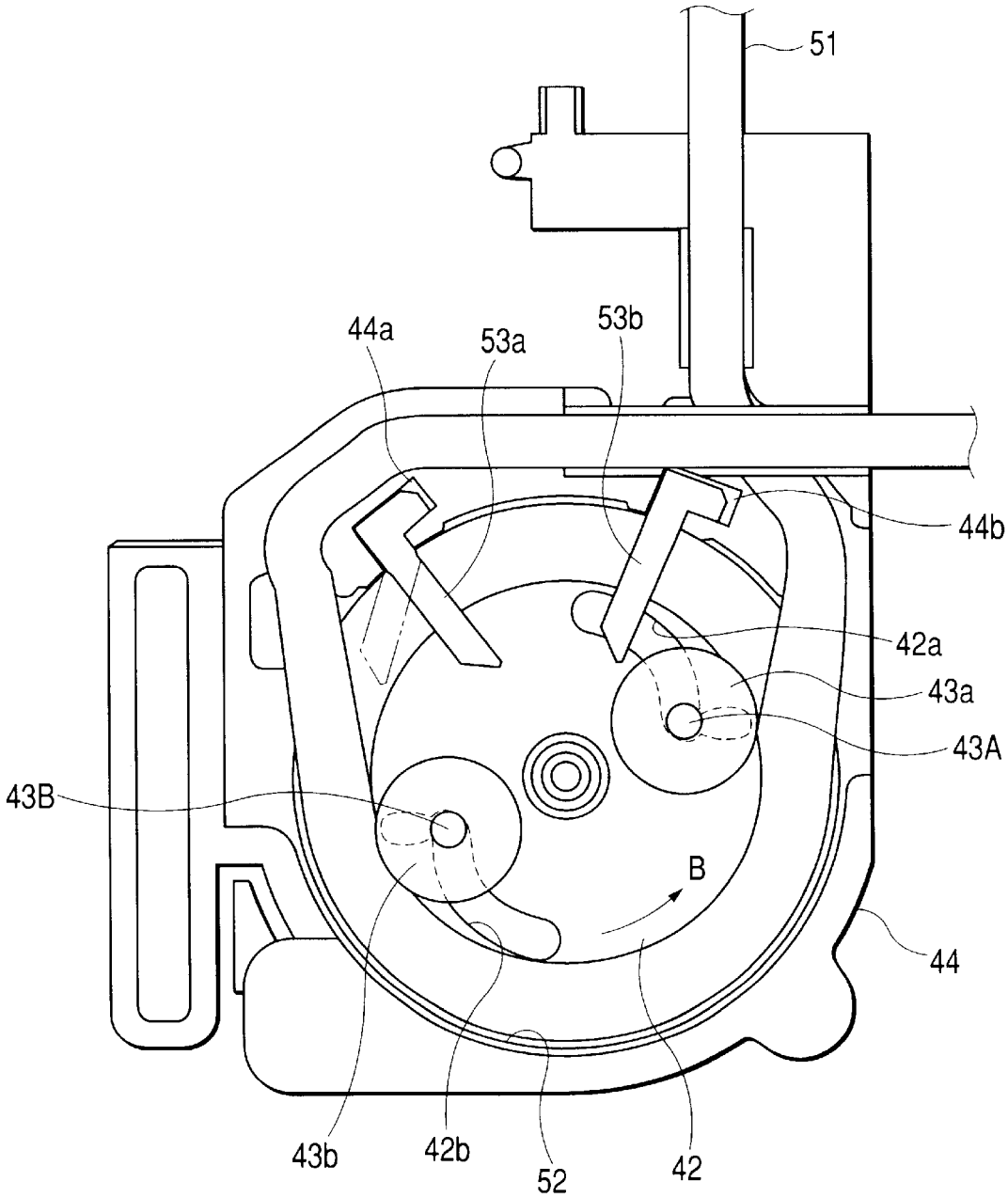
FIG. 8 is a perspective view to show a release operation state as the tube pump in the related art is driven in a reverse direction.

Members (parts) identical with or similar to those previously described with reference to FIGS. 7 and 8 are denoted by the same reference numerals in FIGS. 3 to 5 and will not be discussed again in detail.

A pump frame 44 (shown in FIGS. 7 and 8) has a tube support face 52 such that the contact area between a flexible tube 51 and a roller 43*a* is provided substantially all around the circumference of the pump wheel 42 (namely 360 degrees), as shown in FIG. 3.

A pump wheel 42 shown in FIGS. 3 to 5 is switched between pump operation and release operation as it rotates in either of the two different rotation directions.

The pump operation refers to operation wherein as the pump wheel 42 rotates in one direction, the roller 43*a* leans to the outer peripheral portion of the wheel and pressurizes the flexible tube 51 between the roller 43*a* and the tube support face 52 for producing suction operation. On the other hand, the release operation refers to operation wherein as the pump wheel 42 rotates in an opposite direction, the roller 43*a* leans to the wheel center portion of the pump wheel 42 and does not pressurize the flexible tube 51.

The pump wheel 42 is formed with a single roller support groove 42*a* at a position eccentric from the wheel center (rotation center) and opened to both end faces of the wheel. Each opening of the roller support groove 42*a* is formed with such a gradient crossing the wheel diameter direction between the wheel center portion and the wheel peripheral portion. As shown in FIGS. 3 and 4, a groove wall 42A of the roller support groove 42*a* is formed by such a cam face wherein the roller 43*a* rotates and rolls and is displaced from release operation position a to pump operation position b with rotation of the pump wheel 42 in pump operation direction A from the release operation state and wherein the roller 43*a* stops rotating and rolling and is displaced from the pump operation position b to the release operation position a with rotation of the pump wheel 42 in release operation direction B from the pump operation state.

Thus, the cam curve of the groove wall (cam face) 42A in the roller support groove 42*a* is a curve with an arbitrary point on a line represented by polar coordinates (r, θ) wherein the rotation center of the pump wheel 42 is origin O, radius r (mm) is a function of angle θ (radians) found from $r=C_1\times\exp(\alpha\cdot\theta)$, and end angle $\theta_\beta$ (start angle $\theta=\theta_0=0$) is a constant found from $\theta_\beta=(1/\alpha)\times\log(C_2/C_1)$.

However, polar coordinates (r, θ) of both end points a (release operation position) and b (pump operation position) on the cam curve are set to predetermined polar coordinates ($C_1$=6.530, 0) and ($C_2$=7.950, $\theta_\beta$). Pressure angle α (radians) of the groove wall 42A with respect to the roller shaft 43A is set to $\alpha=7\pi/180$ (7°).

The pressure angle α is the angle resulting from subtracting angle π/2 from the angle between line $A_1, A_2, A_3, \ldots, A_{19}$ connecting the rotation center O of the pump wheel 42 and arbitrary point $a_1, a_2, a_3, \ldots, a_{19}$ and tangent $B_1, B_2, B_3, \ldots, B_{19}$ to the cam curve at $a_1, a_2, a_3, \ldots, a_{19}$ on the line $A_1, A_2, A_3, \ldots, A_{19}$, as shown in FIG. 4.

If the pressure angle α (radians) is set to $\alpha=7\pi/180$ (7°) and the polar coordinates (r, θ) of both end points a and b on the cam curve are set to (6.530, 0) and (7.950, $\theta_\beta$), the end angle $\theta_\beta$ becomes $\theta_\beta=\pi/2$ and thus the polar coordinates (r, θ) of the arbitrary points $a_1, a_2, a_3, \ldots, a_{19}$ on the cam curve of the roller support groove 42*a* become as shown under the column of pressure angle α=7° in Table 1. In the table, the polar coordinates (r, θ) of the arbitrary points $a_5$ and $a_{12}$ on the cam curve become (6.822, π/9) and (7.364, 55π/180).

In the table, r (radius) is in mm units and θ, α (angle) is in ° (degree) units

TABLE 1

| | PRESSURE ANGLE (α = 6°) | | | | | | | |
|---|---|---|---|---|---|---|---|---|
| | | RAD- | (α = 7°) | | (α = 8°) | | (α = 9°) | |
| | ANGLE(θ) | IUS(r) | (θ) | (r) | (θ) | (r) | (θ) | (r) |
| $\alpha_1$ | 0 | 6.530 | 0 | 6.530 | 0 | 6.530 | 0 | 6.530 |
| $\alpha_2$ | 5 | 6.589 | 5 | 6.602 | 6 | 6.611 | 5 | 6.622 |
| $\alpha_3$ | 10 | 6.648 | 10 | 6.674 | 10 | 6.693 | 10 | 6.716 |
| $\alpha_4$ | 15 | 6.708 | 15 | 6.748 | 15 | 6.775 | 15 | 6.811 |
| $\alpha_5$ | 20 | 6.768 | 20 | 6.822 | 20 | 6.859 | 20 | 6.908 |
| $\alpha_6$ | 25 | 6.829 | 25 | 6.897 | 25 | 6.944 | 25 | 7.005 |
| $\alpha_7$ | 30 | 6.890 | 30 | 6.973 | 30 | 7.030 | 30 | 7.105 |
| $\alpha_8$ | 35 | 6.952 | 35 | 7.049 | 35 | 7.117 | 35 | 7.205 |
| $\alpha_9$ | 40 | 7.014 | 40 | 7.127 | 40 | 7.205 | 40 | 7.307 |
| $\alpha_{10}$ | 45 | 7.077 | 45 | 7.205 | 45 | 7.294 | 45 | 7.411 |
| $\alpha_{11}$ | 50 | 7.141 | 50 | 7.284 | 50 | 7.385 | 50 | 7.515 |
| $\alpha_{12}$ | 55 | 7.205 | 55 | 7.364 | 55 | 7.476 | 55 | 7.622 |
| $\alpha_{13}$ | 60 | 7.270 | 60 | 7.445 | 60 | 7.568 | 60 | 7.730 |
| $\alpha_{14}$ | 65 | 7.335 | 65 | 7.527 | 65 | 7.662 | 65 | 7.839 |
| $\alpha_{15}$ | 70 | 7.401 | 70 | 7.610 | 70 | 7.757 | 70 | 7.950 |
| $\alpha_{16}$ | 75 | 7.468 | 75 | 7.694 | 75 | 7.853 | — | — |
| $\alpha_{17}$ | 80 | 7.535 | 80 | 7.778 | 80 | 7.950 | — | — |
| $\alpha_{18}$ | 85 | 7.602 | 85 | 7.864 | — | — | — | — |
| $\alpha_{19}$ | 90 | 7.671 | 90 | 7.950 | — | — | — | — |
| $\alpha_{20}$ | 95 | 7.740 | — | — | — | — | — | — |
| $\alpha_{21}$ | 100 | 7.809 | — | — | — | — | — | — |
| $\alpha_{22}$ | 105 | 7.879 | — | — | — | — | — | — |
| $\alpha_{23}$ | 110 | 7.950 | — | — | — | — | — | — |

At the axial end part of the pump wheel 42, a roller guide 55 is provided integrally via a joint part 56, as shown in FIG. 5. The roller guide 55 is formed in a side face portion with a guide face 55*a* for guiding the roller shaft 43A together with the groove wall 42A of the roller support groove 42*a*. The guide face 55*a* is formed by a cam face similar to that of the groove wall 42A of the roller support groove 42*a*.

Since the tube pump is thus configured, when the release operation state is switched to the pump operation state, the roller 43*a* rotates and rolls and receives such a force displacing from the release operation position a to the pump operation position b from the groove wall 42A of the roller support groove 42*a* (the guide face 55*a* of the roller guide 55).

On the other hand, when the pump operation state is switched to the release operation state, the roller 43*a* remains immobile and receives such a force displacing from the pump operation position b to the release operation position a from the groove wall 42A of the roller support groove 42*a*.

Therefore, in the embodiment, just after the pump operation state is switched to the release operation state, the roller 43*a* is prevented from rotating and rolling in the wheel rotation direction while pressing the flexible tube 51, so that fluids of ink, air, etc., in the flexible tube 51 do not flow back and the reliability on the pump quality can be enhanced.

In the embodiment, the case where the pressure angle α is set to $\alpha=7\pi/180$ (7°) has been described, but the invention is not limited to it and if the pressure angle α is set to $\alpha=8\pi/180$ (8°), a similar advantage to that of the embodiment can be provided.

In this case, if the polar coordinates (r, θ) of both end points a and b on the cam curve are set to (6.530, 0) and (7.950, $\theta_\beta$) as in the embodiment, the end angle $\theta_\beta$ becomes $\theta_\beta=4\pi/9$. Accordingly, the polar coordinates (r, θ) of the arbitrary points $a_1, a_2, a_3, \ldots, a_{17}$ on the cam curve of the roller support groove 42*a* become as shown under the column of pressure angle α=8° in Table 1. In the table, for example, the polar coordinates (r, θ) of the arbitrary points $a_3$ and $a_{15}$ on the cam curve become (6.693, π/18) and (7.757, 7π/180).

However, if the pressure angle α is set to α=π/30 (6°) or π/20 (9°) (Table 1 lists the polar coordinates of arbitrary points $a_1, a_2, a_3, \ldots, a_{23}$ and $a_1, a_2, a_3, \ldots, a_{15}$ on the cam curve of the roller support groove 42*a*), the advantage as shown in the embodiment cannot be provided.

That is, if the pressure angle α is set to α=π/30, when the pump operation state is switched to the release operation state, the roller 43*a* does not move toward the release operation position and moves interlockingly with the pump wheel 42 while pressing the flexible tube 51 at an intermediate position in the roller support groove 42*a*. On the other hand, if the pressure angle α is set to α=π/20 (9°), when the release operation state is switched to the pump operation state, the roller 43*a* does not move toward the pump operation position b and moves interlockingly with the pump wheel 42.

Thus, it is desirable that the pressure angle α of the groove wall (cam face) 42A in the roller support groove 42*a* should be set to a predetermined angle in the range of π/30<α (radians)<π/20.

In addition, in the embodiment, the contact area between the roller 43*a* and the flexible tube 51 is provided as the contact area substantially all around the circumference of the pump holder 42 (almost 360 degrees), so that the contact area becomes long in the circumferential direction and a higher negative pressure can be provided as compared with the related art example (wherein the contact area is almost half of the circumference of the wheel, shown in FIGS. 7 and 8).

In the embodiment, the contact area between the roller 43*a* and the flexible tube 51 is provided as the contact area almost all around the circumference of the roller 43*a*, so that at the wheel rotation time, the roller shaft 43A can be guided in the opposite direction to the rotation direction of the pump wheel 42 and thus the guide member (shown in FIGS. 7 and 8) formerly required becomes unnecessary.

Further, in the embodiment, the number of rollers 43*a* is one, so that the number of parts and the number of assembling steps can also be decreased.

On the other hand, to use the tube pump 10 in the embodiment with the ink jet recording apparatus, fluids of ink, air, etc., sucked from the recording head 12 can be prevented from flowing back into the capping device 9.

Therefore, ink bubbles produced as in the related art are not produced, so that destroying of meniscuses as ink bubbles are broken can be prevented.

Thus, the normal ejection operation of ink droplets through the nozzle openings can be accomplished, so that a print fault called missing dots does not occur and the reliability on cleaning can be enhanced.

Figure 6:
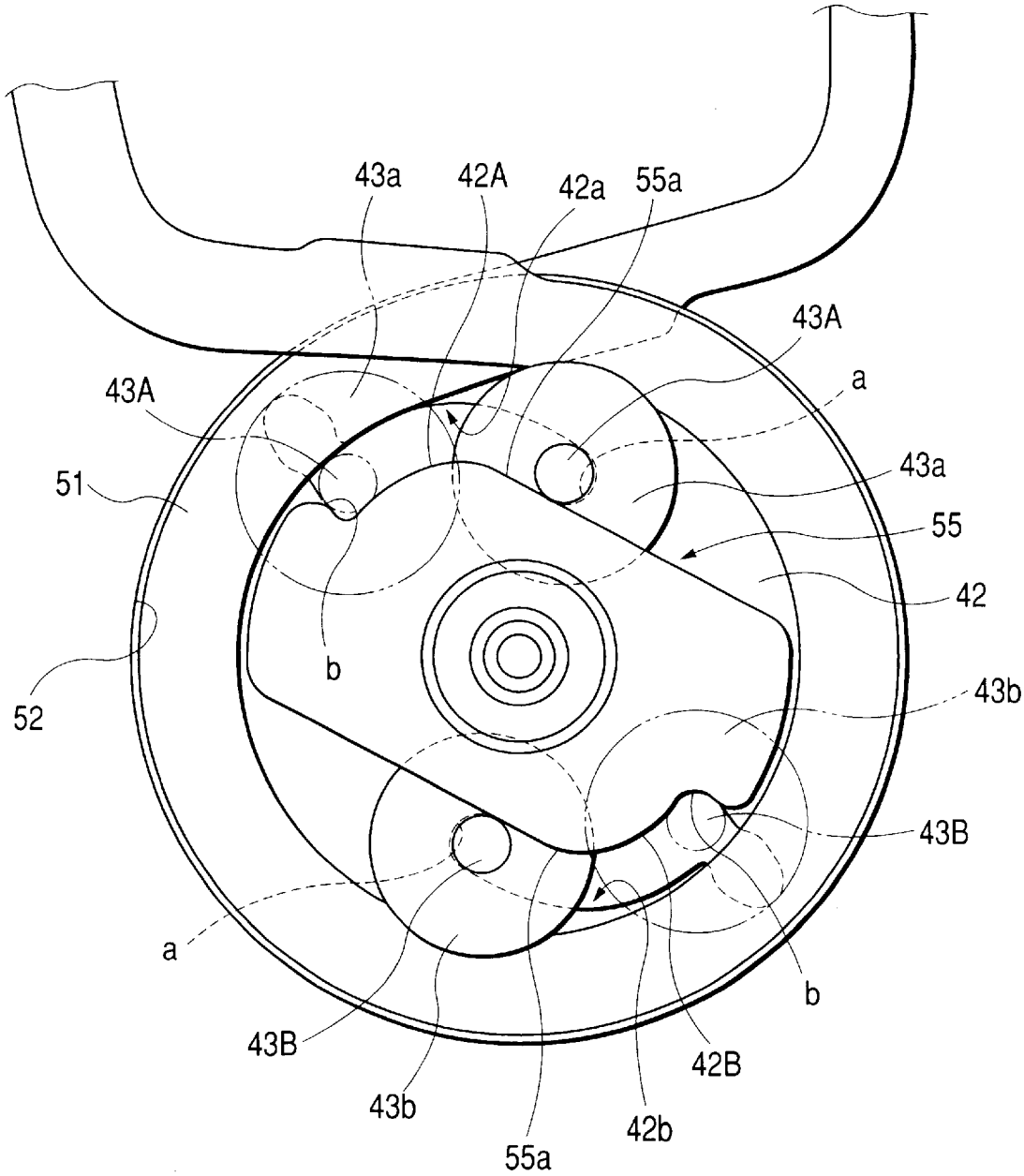
FIG. 6 is a perspective view to show the main part of a tube pump according to a second embodiment of the invention.

Next, a second embodiment of the invention will be discussed with reference to FIG. 6. FIG. 6 is a plan view to show the main part of a tube pump according to the second embodiment of the invention. Members identical with those previously described with reference to FIGS. 3 to 5 are denoted by the same reference numerals in FIG. 6 and will not be discussed again in detail.

A pump wheel 42 shown in FIG. 6 is formed with a pair of roller support grooves 42*a* and 42*b* positioned at parts symmetrical with respect to a point about the wheel center (rotation center) and opened to both end faces of the wheel. One roller support groove 42*a* is the same as that previously described in the first embodiment and therefore the other roller support groove 42*b* will be discussed. As with the roller support groove 42*a*, each opening of the roller support groove 42*b* is formed with such a gradient crossing the wheel diameter direction between the wheel center portion and the wheel peripheral portion.

A groove wall 42B of the roller support groove 42*b* is formed by such a cam face wherein the roller 43*b* rotates and rolls and is displaced from release operation position a to pump operation position b with rotation of the pump wheel 42 in a pump operation direction from the release operation state and wherein the rollers 43*a* and 43*b* stop rotating and rolling and is displaced from the pump operation position b to the release operation position a with rotation of the pump wheel 42 in a release operation direction from the pump operation state.

Thus, the cam curve of the groove wall (cam face) 42B in the roller support groove 42*b*, like the cam curve of the groove wall 42A in the roller support groove 42*a*, is also a curve with an arbitrary point on a line represented by polar coordinates (r, θ) wherein the rotation center of the pump wheel 42 is origin O, radius r (mm) is a function of angle θ (radians) found from $r=C_1\times\exp(\alpha\cdot\theta)$, and end angle $\theta_\beta$ (start angle $\theta=\theta_0=0$) is a constant found from $\theta_\beta=(1/\alpha)\times\log(C_2/C_1)$.

However, polar coordinates (r, θ) of both end points a (release operation position) and b (pump operation position) on the cam curve are set to predetermined polar coordinates ($C_1$=6.530, 0) and ($C_2$=7.950, $\theta_\beta$). Pressure angle α (radians) of the groove wall 42B with respect to the roller shaft 43B is set to a predetermined angle in the range of π/30<α (radians)<π/20.

Since the tube pump is thus configured, when the release operation state is switched to the pump operation state, the rollers 43*a* and 43*b* rotate and roll and receive such a force displacing from the release operation position a to the pump operation position b from the groove walls 42A and 42B of the roller support grooves 42*a* and 42*b*.

On the other hand, when the pump operation state is switched to the release operation state, the rollers 43*a* and 43*b* remain immobile and receive such a force displacing from the pump operation position b to the release operation position a from the groove walls 42A and 42B of the roller support grooves 42*a* and 42*b*.

Therefore, in the embodiment, just after the pump operation state is switched to the release operation state, the rollers 43*a* and 43*b* are prevented from rotating and rolling in the wheel rotation direction while pressing a flexible tube 51, so that fluids of ink, air, etc., in the flexible tube 51 do not flow back and the reliability on the pump quality can be enhanced as in the first embodiment.

In the second embodiment, the contact area between the rollers 43*a* and 43*b* and the flexible tube 51 is provided in the area almost all around the pump wheel 42. Thus, as with the first embodiment, a high negative pressure can be provided and the guide member (shown in FIGS. 7 and 8) becomes unnecessary as compared with the related art example.

On the other hand, to use the tube pump 10 in the embodiment with the ink jet recording apparatus, fluids of ink, air, etc., sucked from the recording head 12 can be prevented from flowing back into the capping device 9, so that a print fault called missing dots can be prevented from occurring and the reliability on cleaning can be enhanced as in the first embodiment.

In the described embodiments, the tube support face 52 is the tube support face such that the contact area between the flexible tube 51 and the roller becomes almost all around the circumference of the pump wheel 42, however the invention is not limited to it. The invention can also be applied to the cases where the tube support face 52 is the tube support face such that the contact area is provided on a half of the circumference of the pump wheel.

In the embodiment, the case where the paper feed motor is used as the drive source of the tube pump 10 and is also used as the drive source of the paper feed and ejection mechanism has been described, but the invention is not limited to it and separate drive sources may be provided for the tube pump 10 and the paper feed and ejection mechanism, of course.

As seen in the description made above, according to the tube pump according to the invention, the reliability on the pump quality can be enhanced and the whole structure can be simplified and costs can be reduced.

To use the tube pump according to the invention as a pump unit of the ink jet recording apparatus, the reliability on cleaning can be enhanced.

What is claimed is:

1. A tube pump comprising:

a pump frame having a tube support face for guiding a curve of a flexible tube in a circular-arc manner;

a pump wheel rotatably disposed in the pump frame and having a roller support groove with a groove wall;

a roller having a roller shaft, disposed rotatably and rollably on the pump wheel and relatively displaceable between a pump operation position and a release operation position in the roller support groove, the roller being configured to deform the flexible tube by a press contact so as to generate a pressure in the tube pump; and the roller shaft being guided by the groove wall in contact therewith;

wherein the groove wall of the roller support groove is provided with a cam face configured such that when the pump wheel rotates from a release operation state in a pump operation direction, the roller is relatively displaced by rotating and rolling, from the release operation position to the pump operation position, and when the pump wheel rotates from a pump operation state in a release operation direction, the roller is relatively displaced without rotating and rolling from the pump operation position to the release operation position.

2. The tube pump according to claim 1, wherein a cam curve of the cam face is a curve with an arbitrary point on a line represented by polar coordinates (r, θ) wherein the rotation center of the pump wheel is an origin, radius r is a function of angle θ found from $r=C_1\times\exp(\alpha\cdot\theta)$, and $\theta_\beta$ represents an end angle and is a constant found from $\theta_\beta=(1/\alpha)\times\log(C_2/C_1)$, and wherein the polar coordinates (r, θ) of both end points on the curve are set to predetermined polar coordinates $(C_1, 0)$ and $(C_2, \theta_\beta)$, α represents a pressure angle of the cam face with respect to the roller shaft is set to a predetermined angle in the range of $\pi/30<\alpha<\pi/20$ and $C_1$ and $C_2$ are set to a predetermined number based on the pressure angle α.

3. The tube pump according to claim 1, wherein a roller guide having a guide face for guiding the roller shaft is placed on an axis of the pump wheel.

4. The tube pump according to claim 1, wherein the tube support face is a tube support face such that a contact area between the flexible tube and the roller is provided substantially all around a circumference of the pump wheel.

5. The tube pump according to claim 1, wherein the roller support groove is a single roller support groove at a position eccentric from the rotation center of the pump wheel.

6. The tube pump according to claim 1, wherein the roller support groove is a pair of roller support grooves positioned at parts symmetrical with respect to a point about the rotation center of the pump wheel.

7. An ink jet recording apparatus comprising:

an ink jet recording head for ejecting ink droplets in response to print data;

a capping device for sealing a nozzle formation face of the recording head and sucking and discharging ink from the recording head upon reception of a negative pressure from a pump unit; and a tube pump according to claim 1 as a pump unit.

8. A tube pump comprising:

a pump frame having a tube support face for guiding a curve of a flexible tube in a circular-arc manner;

a pump wheel rotatably disposed in the pump frame and having a roller support groove with a groove wall; and a roller having a roller shaft, disposed rotatably and rollably on the pump wheel and relatively displaceable between a pump operation position and a release operation position in the roller support groove, the roller being configured to deform the flexible tube by a press contact so as to generate a pressure in the tube pump;

the roller shaft being guided by the groove wall having a cam surface in contact therewith;

wherein a cam curve of the cam face is a curve with an arbitrary point on a line represented by polar coordinates (r, θ) wherein the rotation center of the pump wheel is an origin, radius r is a function of angle θ found from $r=C_1\times\exp(\alpha\cdot\theta)$, and $\theta_\beta$ represents an end angle and is a constant found from $\theta_\beta=(1/\alpha)\times\log(C_2/C_1)$, and wherein the polar coordinates (r, θ) of both end points on the curve are set to predetermined polar coordinates $(C_1$ 0) and $(C_2, \theta_\beta)$, and α represents a pressure angle of the cam face with respect to the roller shaft is set to a predetermined angle in the range of $\pi/30<\alpha<\pi/20$ and $C_1$ and $C_2$ are set to a predetermined number based on the pressure angle α.

* * * * *

UNITED STATES PATENT AND TRADEMARK OFFICE

CERTIFICATE OF CORRECTION

PATENT NO. : 6,733,255 B2
DATED : May 11, 2004
INVENTOR(S) : Mitsugu Ota and Takashi Koase It is certified that error appears in the above-identified patent and that said Letters Patent is hereby corrected as shown below:

Title page,
Item [22], PCT filing date, delete "August 19, 2002" and insert -- Filing date: May 23, 2002 --

Signed and Sealed this

Seventeenth Day of August, 2004

JON W. DUDAS
*Acting Director of the United States Patent and Trademark Office*